US005158295A

United States Patent [19]

Shilling

[11] Patent Number: 5,158,295

[45] Date of Patent: Oct. 27, 1992

[54] PICTURE PUZZLE ASSEMBLY

[76] Inventor: Robert A. Shilling, 915 N. 3rd St., Renton, Wash. 98055

[21] Appl. No.: 703,681

[22] Filed: May 21, 1991

[51] Int. Cl.[5] ..... A63F 9/10

[52] U.S. Cl. ..... 273/157 R; 40/152; 40/600

[58] Field of Search ..... 273/157 R; 40/152, 600

[56] References Cited

U.S. PATENT DOCUMENTS

| | | | |
|---|---|---|---|
| 4,051,607 | 10/1977 | Sullivan | 273/157 R |
| 4,170,080 | 10/1979 | Bergh | 40/152 |
| 4,258,920 | 3/1981 | Waldron et al. | 273/157 R |
| 4,976,055 | 12/1990 | Kane | 40/152 X |

FOREIGN PATENT DOCUMENTS

| | | | |
|---|---|---|---|
| 2418661 | 11/1979 | France | 273/157 R |
| 2642320 | 8/1990 | France | 273/157 R |
| 2135201 | 8/1984 | United Kingdom | 273/157 R |

OTHER PUBLICATIONS

"Playthings", Puzzle-Up magnetic jigsaw puzzle, Dec., 1973, p. 54.

*Primary Examiner*—Benjamin H. Layno
*Assistant Examiner*—William M. Pierce
*Attorney, Agent, or Firm*—Seed and Berry

[57] ABSTRACT

A picture puzzle of the "jigsaw" type has a magnetic backing on each piece used to adhere the assembled puzzle to a ferrous backing plate which may be framed and wall-hung. The puzzle is free to be reused.

1 Claim, 1 Drawing Sheet

PICTURE PUZZLE ASSEMBLY

TECHNICAL FIELD

The present invention relates to puzzles in which multiple planar pieces, each presenting a portion of a picture, are adapted to be interfitted to form a sheet presenting the picture. Such puzzles are commonly referred to as "jigsaw" puzzles.

BACKGROUND OF THE INVENTION

Commonly, the pictures on a jigsaw puzzle are of high quality. However, heretofore, there has been not been a convenient way to wall-mount the assembled puzzle and yet leave it in a form suitable for reuse.

SUMMARY OF THE INVENTION

The present invention provides the standard jigsaw puzzle with a magnetic back whereby the pieces of the puzzle will adhere by magnetic attraction to a ferrous backing plate. This plate may be provided with a picture frame. Trim strips with magnetic backing may be used to fill any space existing between the border of the assembled puzzle and the picture frame. The magnetic backing on the puzzle is applied as a back layer before the puzzle is divided into multiple pieces during manufacture.

DETAILED DESCRIPTION OF THE INVENTION

Figure 1:
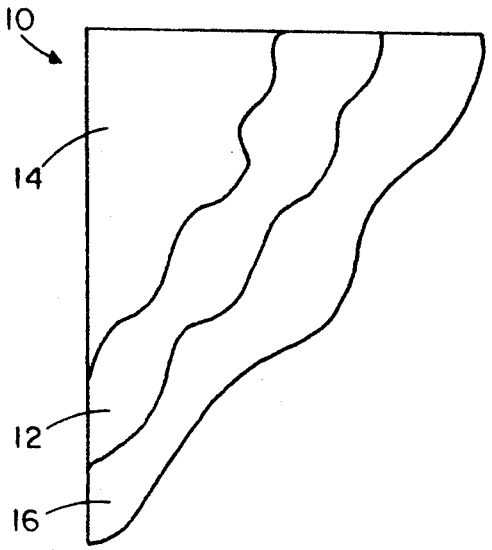
FIG. 1 is a fragmentary front plan view showing a puzzle sheet made in accordance with the present invention before being divided into puzzle pieces.
Figure 3:
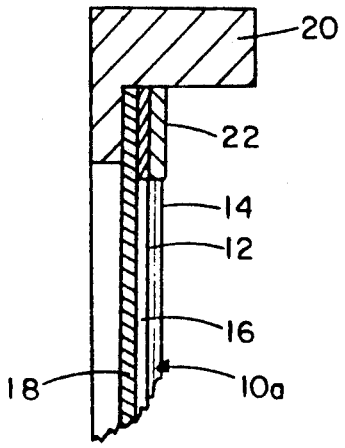
FIG. 3 is an enlarged sectional view taken as indicated by lines 3—3 in FIG. 2.
Figure 2:
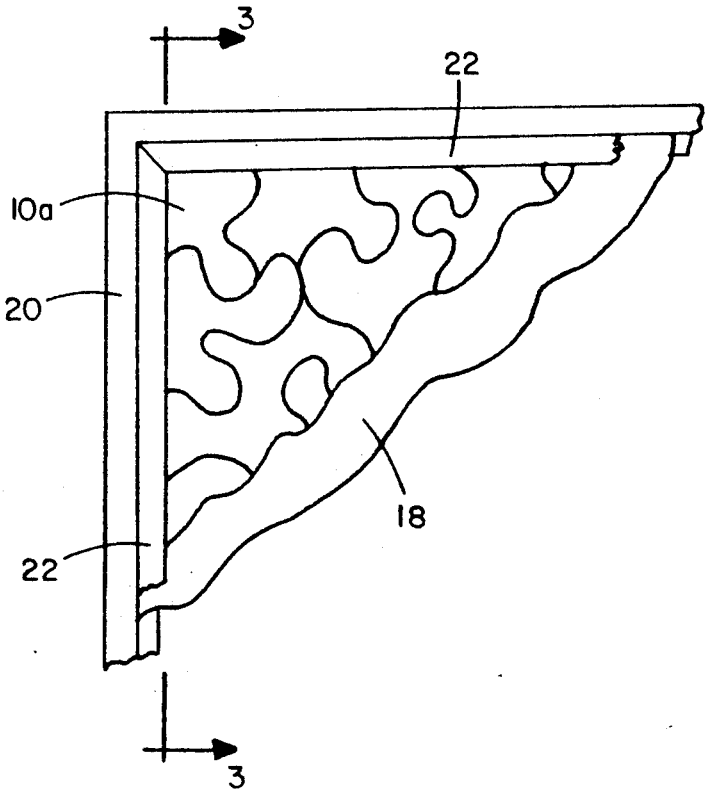
FIG. 2 is a fragmentary front elevation view of an assembled puzzle and frame assembly in accordance with the invention.

In the practice of the present invention, a laminated sheet 10 is formed having a stiff planar core layer 122, a front picture presenting layer 14, and a back magnetic layer 16.

The core layer 12 may be stiff cardboard or any other suitable material presently commonly used for jigsaw puzzles; and the picture-presenting layer 14 may, for example, be a paper sheet upon which a picture (not shown) has been printed. The layers 12, 14 are bonded together by a suitable adhesive. It is intended that standard practices in the puzzle industry be used in forming the core layer faced with a picture.

The present invention involves providing the back magnetic layer 16. This layer comprises a flexible magnetic sheeting which may be 0.030 inch thick and be like that sold under the trademark ZIP-GRIP TM by Master Magnetics, Inc., Castle Rock, Colo. A suitable adhesive bonds the magnetic layer 16 to the core layer 12. The back side of the magnetic layer 16 may have a vinyl coating.

After the layers 12, 14, and 16 are bonded together to form the sheet 10, the sheet is cut into multiple puzzle pieces 10*a* in the standard manner. Each resulting puzzle piece has a magnetic backing and presents part of a picture on its front side.

As part of the invention, a ferrous backing plate 18 is provided of a size to receive the puzzle when it is assembled. The backing plate 18 may be a piece of galvanized sheet metal.

Preferably, a suitable border frame 20 is provided to receive the backing plate 18. It is intended that this frame 20 be any of a variety of standard picture frames of the type adapted to receive a glass picture-covering sheet; hence details of the frame are not critical. Standard picture-hanging elements can be mounted on the back of the frame 20 or backing plate 18.

A single size of border frame and backing plate unit 18, 20 can be used with several smaller sizes of puzzles by use of trim strips 22 having magnetic backings like the magnetic backing 16 on the puzzle. The trim strips 22 are cut to fit between the periphery of the puzzle sheet 10 and the border frame 20.

The puzzle may be assembled on the backing plate 18, or on another surface, and then moved onto the backing plate. The frame 20 and backing plate 18 can be preassembled as a unit before the puzzle is placed on the backing plate or can be assembled later. After the assembled puzzle is positioned on the backing plate 18, trim strips 22 may be applied to the backing plate to fill the gaps, if any, between the periphery of the puzzle sheet 10 and the frame 20. The resulting assembly results in a framed picture suitable for wall hanging and puzzle storage while leaving the puzzle ready to be reused.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A combination puzzle and picture assembly comprising:

multiple puzzles pieces adapted to interfit to form a planar puzzle sheet, each puzzle piece having a stiff, flat core, a front picture portion bonded to said core, and a back magnetized sheeting section, the picture portions of the puzzle pieces collectively presenting a picture when interfitted;

a backing plate of a size to receive said planar sheet thereon, with each said magnetized sheeting section being held in place thereon by magnetic attraction to hold said puzzle pieces on the backing plate;

a border frame mounted on said backing plate and having an internal circumference larger than the periphery of said puzzle sheet; and a border trim section seated against said backing plate and filling the space between said puzzle sheet and border frame, said trim section having a back side including magnetized material for holding the trim section in position by magnetic attraction to the backing plate.

* * * * *